United States Patent [19]

Anderson et al.

[11] Patent Number: 4,553,370

[45] Date of Patent: Nov. 19, 1985

[54] BAG FOLDER, TRANSPORTER AND CARTON LOADER HAVING IMPROVED LOADING AND STOMPER MECHANISM

[75] Inventors: Thomas L. Anderson, Webster; F. John Herrington, Holcomb, both of N.Y.

[73] Assignee: Mobil Oil Corporation, New York, N.Y.

[21] Appl. No.: 521,804

[22] Filed: Aug. 10, 1983

[51] Int. Cl.[4] ..... B65H 45/00

[52] U.S. Cl. ..... 53/117; 493/448; 493/457

[58] Field of Search ..... 53/117, 447, 429; 493/457, 456, 438, 447, 448, 179

[56] References Cited

U.S. PATENT DOCUMENTS

| | | | |
|---|---|---|---|
| 1,708,534 | 4/1929 | Christman, Jr. | 493/457 X |
| 2,921,726 | 1/1960 | Maxwell et al. | 53/117 X |
| 3,057,133 | 10/1962 | Gayring et al. | 53/117 |
| 3,842,568 | 10/1974 | Spencer | 53/118 X |
| 3,917,253 | 11/1975 | Arbter | 493/457 |
| 3,918,699 | 11/1975 | Arbter | 493/457 X |
| 3,919,827 | 11/1975 | Larson et al. | 53/429 |
| 4,008,887 | 2/1977 | Karolyi | 493/457 |
| 4,037,386 | 7/1977 | Sjoman | 53/429 |

FOREIGN PATENT DOCUMENTS

| | | | |
|---|---|---|---|
| 2356877 | 5/1975 | Fed. Rep. of Germany | 53/117 |
| 2742260 | 4/1978 | Fed. Rep. of Germany | 53/117 |

*Primary Examiner*—James F. Coan

*Attorney, Agent, or Firm*—Alexander J. McKillop; Michael G. Gilman; Charles J. Speciale

[57] ABSTRACT

Disclosed is an improved folding and loading mechanism for small, limp, sheet-like articles. A pair of pivotal support trays are biased to form a horizontal platform, upon which each sheet-like article is placed and then folded by pivoting flippers. After folding, a propulsion mechanism moves from a rest position and pushes the support trays out of the way and further pushes the folded article into a carton residing below the platform. Upon return of the propulsion mechanism to a rest position, the biasing on the support trays returns them to again form the horizontal platform. The propulsion mechanism can be a separate stomper member positioned above the platform.

27 Claims, 22 Drawing Figures

BAG FOLDER, TRANSPORTER AND CARTON LOADER HAVING IMPROVED LOADING AND STOMPER MECHANISM

CROSS-REFERENCE TO RELATED APPLICATIONS

This application relates to subject matter disclosed and claimed in co-pending U.S. application Ser. No. 329,371, filed Dec. 10, 1981 and assigned to the same assignee as the present invention, the disclosure of which is incorporated herein by reference.

BACKGROUND OF THE INVENTION

1. Field of the Invention

This invention relates to an apparatus for folding and loading thin, limp, sheet-like articles into a receptacle therefor and particularly relates to an apparatus for folding and loading small plastic bags, such as sandwich bags, into a dispensing box or carton. It also more particularly relates to an improved mechanism for loading a sheet-like article into a dispensing box or carton.

2. Discussion of the Prior Art

As described in the above-referenced application, plastic sheet materials present many handling and dispensing problems which are magnified when the sheet is thin, limp and subject to loading by static electricity. Exemplary plastic sheet materials which are used in large quantities at the present time are plastic bags, such as trash bags, produce bags and sandwich bags. Many of these bag products are assembled, shipped and dispensed in roll form. Others, however, are preferably handled in folded form because of consumer preferences, economy in storage, and/or ease of handling and dispensing. Folding of such bags can be performed by in-line machinery without great difficulty when the bags are large, as, for example, bulk bags and trash bags.

However, when the bags are quite small, such as sandwich bags, for example, so many difficulties occur with presently available machinery that the present practice is to use manual labor for folding and loading plastic sandwich bags into dispensing boxes therefor. There is consequently a need for new concepts and arrangements that will overcome the specific problems peculiar to folding and loading of such thin plastic articles of relatively small size. These difficulties arise because the bags must be sequentially picked up from a conveyor, folded, folded again, transported to a receptacle, loaded into the receptacle and pressed against its bottom in order to remove entrapped air. In each of these operations, the lightness, limpness, thinness and smallness of the bags present special handling problems, particularly when static electricity is present. Simply scaling down conventional folding machines does not solve these problems, because the prior art devices inherently rely upon significantly greater stiffness, bulk, basis weight and like properties.

A method for sequentially packaging flexible plastic refuse bags is taught in U.S. Pat. No. 3,842,568, which comprises reeling a bag onto a mandrel, pulling it sidewise in reeled condition from the mandrel, and tamping the reeled bag into a carton.

An apparatus is described in U.S. Pat. No. 3,918,699 for multiple folding of soft articles, such as textile and paper articles. It includes a plurality of cooperating longitudinal and transverse folding arms which are operable according to a predetermined sequence and which cooperate with folding plates. More specifically, the middle portion of an article to be folded is brought under a folding plate, while its side portions lie on the longitudinal side folding arms of the machine. The side folding arms then operate toward each other in sequence so they form two folds and longitudinally overlap the two side portions. This prefolded article is next delivered to a second folding station, where transversely disposed folding arms sequentially perform similar single foldings. The longitudinally and transversely folded article is finally delivered to a stacking station.

An apparatus and method for folding textile materials is taught in U.S. Pat. No. 4,008,887. It comprises a plurality of pivotal folding flap plates for sequentially folding the material, while gripping devices at the movable plates prevent unfolding and/or shifting of the material. The gripping members are C-shaped fingerlike elastic elements mounted on rotatable gripper shafts which are connected to rotatable flexible shafts and to a control mechanism for sequentially controlling the rotation of the shafts.

SUMMARY OF THE INVENTION

The above-referenced U.S. application Ser. No. 329,371 discloses an improved method and apparatus for picking up a plurality of thin, limp, sheet-like articles from a conveyor, folding the articles and sequentially loading the folded articles into a receptacle therefor. The apparatus sequentially delivers, folds and loads a plurality of thin, limp, sheet-like articles into a receptacle or carton, after these articles have been sequentially conveyed to a pick-up station, and packs the loaded articles within the carton. The folding and loading mechanism employs a complex linkage assembly for moving support trays, which are first positioned above a carton and used as a support in the folding operation and then moved out of the way during receptacle loading. However, the support trays and associated linkage mechanism have a complex and costly construction.

The present invention is directed to an apparatus for picking up a plurality of thin, limp, sheet-like articles from a conveyor, folding the articles, and sequentially loading the folded articles into a receptacle.

One object of the invention is the provision of an improvement in the apparatus disclosed in application Ser. No. 329,371 for folding and loading articles into a carton or other receptacle and which involves a simplified support tray construction and which eliminates the need to move the support trays by a complex linkage mechanism. Another object of the invention is the provision of an improved loading mechanism which is simpler in construction and operation than that employed in the apparatus disclosed in application Ser. No. 329,371.

These objects, and others, are achieved by providing a pair of pivotal support trays which are biased to form a horizontal platform, upon which each sheet-like article is placed and then folded. After folding, a propulsion mechanism pushes the support trays, causing them to pivot out of the way and further pushes a folded article into a carton residing below the platform. Upon return of the propulsion mechanism to a rest position, the biasing on the support trays return them to again form the horizontal platform. The propulsion mechanism can be a separate stomper member positioned above the platform.

BRIEF DESCRIPTION OF THE DRAWINGS

The invention may be more clearly understood by referring to the following drawings, which show, in FIGS. 1–17 and by way of background, the apparatus described in the above-referenced U.S. application Ser. No. 329,311, and in FIGS. 18–21, the improved apparatus and its operation, which are in accordance with the teachings of the present invention.

DESCRIPTION OF THE EMBODIMENTS

To set the environment for the present invention, the apparatus described in application Ser. No. 329,371 will first be described with reference to FIGS. 1–17, after which the apparatus of the present invention will be described with reference to FIGS. 18–21.

The apparatus disclosed in Ser. No. 329,371 comprises sheet delivering, sheet-folding and folded-sheet loading assemblies, as shown in FIGS. 1–17, which sequentially remove a thin, limp article in sheet form from a conveyor, fold it into thirds and pack the folded article within a receptacle, such as box or carton. The sheet-folding and folded-sheet loading assemblies are described herein as a folder-loader assembly. FIGS. 12–17 illustratively shows a sandwich bag as a suitable thin, limp, sheet-like article, but the apparatus is effective with sheet-like articles of any size if they are limp enough to be readily folded.

Figure 9:
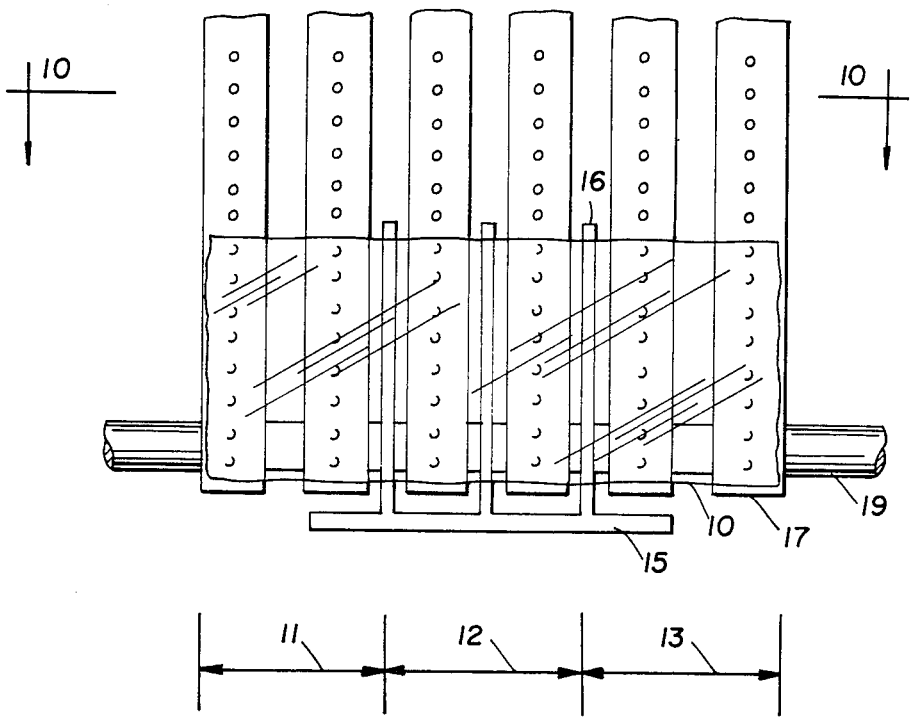
FIG. 9 is a plan view of the pickup station at the end of the bag conveyor, with one bag positioned on the stopped conveyor and centered over the swatter prongs.
Figure 10:
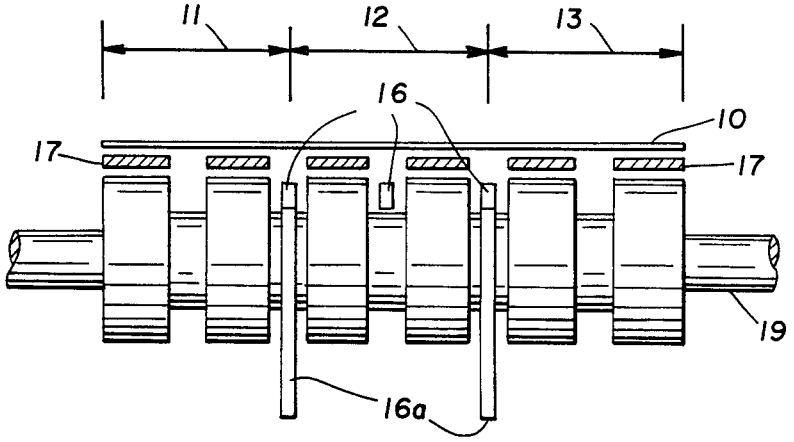
FIG. 10 is a sectional side elevation, looking in the direction of the arrows 10—10 in FIG. 9, which shows the conveyor shaft, conveyor belts, swatter prongs, swatter tines and the bag lying on the belts.

The sheet delivering assembly comprises a pivotable swatter having prongs 16, which nest at a pickup station between conveyor belts 17 before a bag 10 reaches the pickup station, as seen in FIGS. 9 and 10. Conveyor belts 17 stop as soon as a bag 10 arrives at the pickup station, and shaft 15 thereupon rotates through an arc of 180°, if conveyor belts 17 are horizontally disposed, or through an arc of 90°, if conveyor belts 17 are vertically disposed, although other arcs are feasible, such as 135°. In the latter situation, it is generally desirable and sometimes necessary (depending on the size, weight and limpness of the article) that vacuum orifices (not shown in the drawings) be disposed at the pickup station, as is known in the art, in order to exert a slight holding force upon each bag 10 and maintain it in parallel to belts 17 before prongs 16 exert a separating force thereupon.

Figure 5:
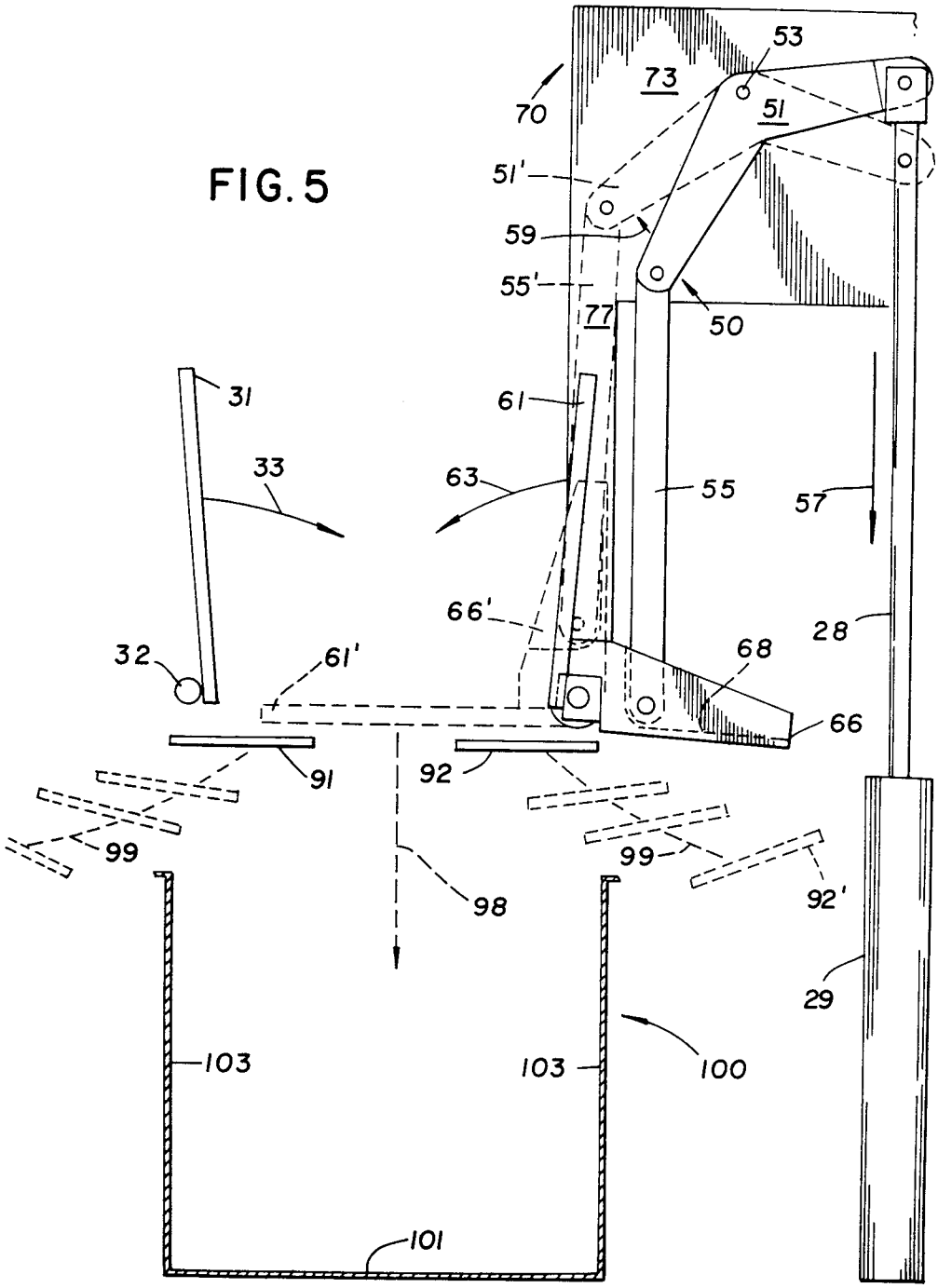
FIG. 5 is a partial sectional view, in elevation and similar to FIG. 4, showing left and right flippers, left and right trays and a rocker arm assembly for pivoting the right flipper, and further showing the pivoted right flipper, right flipper arm and rocker arm in phantom view, with both trays also being in phantom view as they move beyond the carton therebeneath.
Figure 6:
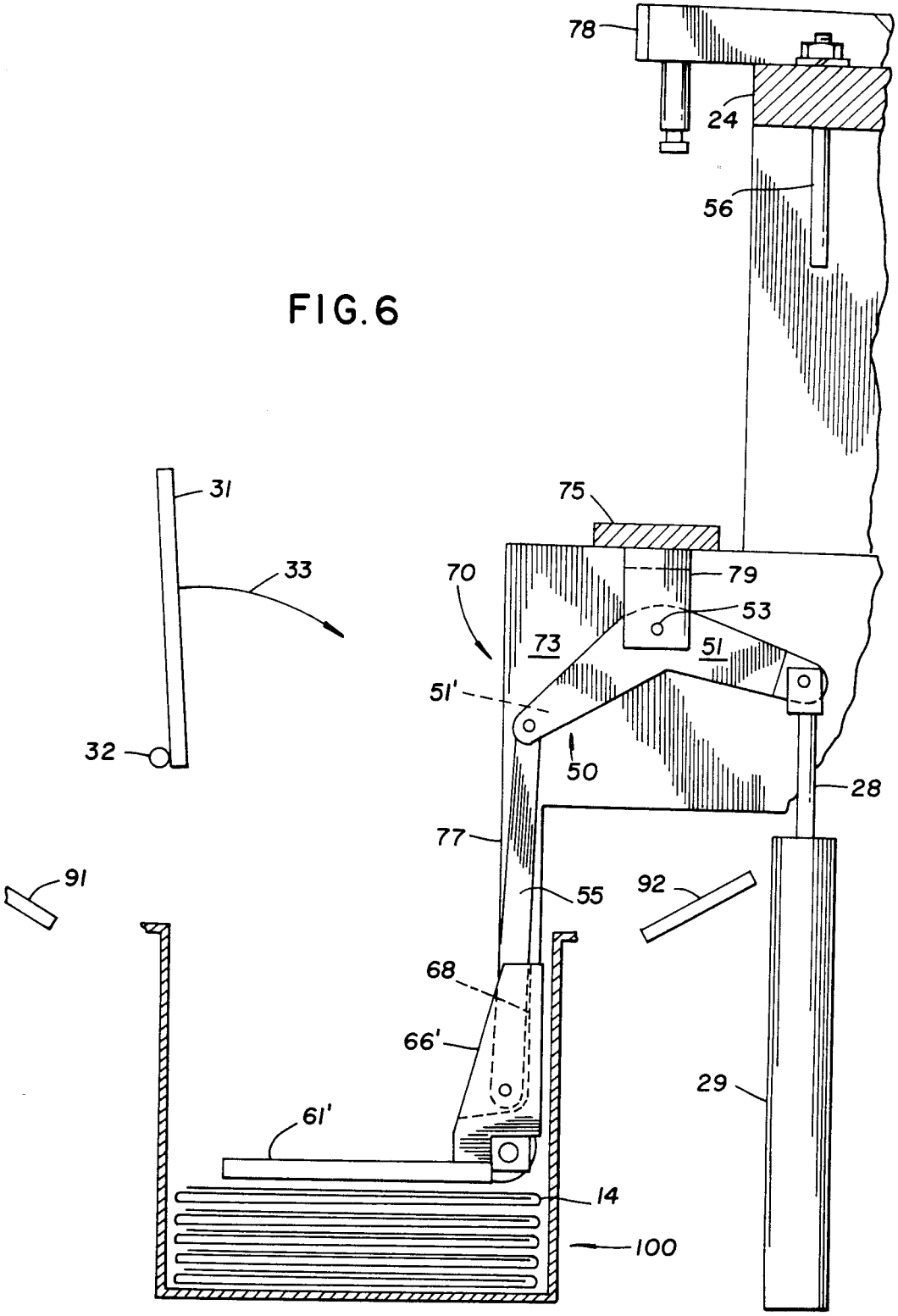
FIG. 6 is a partial sectional view, in elevation and similar to FIG. 5, showing the right flipper performing the packing operation after having loaded a folded bag into the carton and on top of several previously loaded and packed bags.
Figure 12:
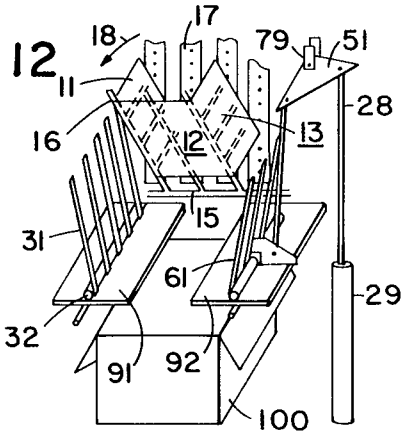
FIG. 12 is a partial perspective view of a carton being used as a receptacle, of a folding station above the carton which includes the left and right trays and the upright left and right flippers above the trays, and of a swatter which is pivotally delivering a partially folded sandwich bag, with its end portions trailing behind its middle portion, which is supported by the swatter at the fold lines, from the conveyor and onto the trays between the flippers.
Figure 17:
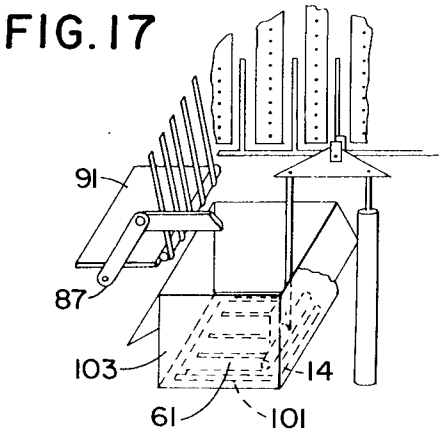
FIG. 17 is a perspective view, similar to FIGS. 12–16, which shows the right flipper pushing the folded bag against the bottom of the box.

Alternatively, a cylinder and cylinder rod having a pickup device may be used as the delivery assembly, or an upside-down conveyor may be employed to deposit the picked-up article in the folding station, seen most clearly in FIGS. 5 and 12.

The swatter lays between conveyor belts 17 of an article-delivering conveyor so that prongs 16 and support tines **16*a* are pivotally beyond each sheet-like article that arrives on conveyor belts 17 and are athwart the article. Moreover, when conveyor belts 17 stop, each article is initially divided into thirds by outer prongs 16, so that center portion 12 of the article is between the outermost prongs 16 and the first and second end portions 11, 13 thereof are endwise beyond these prongs. The swatter is actuated by a cylinder so that shaft 15 rotates through an angle of 90°-180° to deliver the article to a folding station to be described hereinafter. After such delivery, the swatter pivots in the other direction to its waiting position beyond the surfaces of belts 17**.

Figure 13:
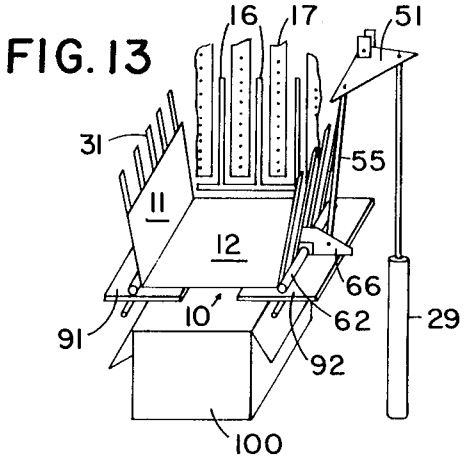
FIG. 13 is a perspective view, similar to FIG. 12, of the sandwich bag resting on the trays and between the flippers in partially folded position.

As visible in FIG. 12, prongs 16 cause bag 10 to be partially folded while it is revolving, because end portions 11, 13 of bag 10 trail behind middle portion 12 at an angle of approximately 90° and at least momentarily remain at this angle after arriving at the folding station, as a U-shaped channel which is formed by trays 91, 92 and flipper tines 31, 61. These end portions 11, 13 remain at least momentarily upright against slightly diverging tines 31, 61, while prongs 16 are pivoting in reverse toward the pickup station, as seen in FIG. 13, after the reverse movement has been completed.

If it is necessary, however, depending upon the limpness of the material of bag 10, tines 31, 61 and shafts 32, 62 can be provided with passages therein which can be connected to a suction/pressure device for selectively producing a vacuum for holding portions 11, 13 against tines 31, 61 and then for producing positive pressure to separate end portions 11, 13 from tines 31, 61 after folding has been completed. Alternatively, vacuum devices can be disposed between tines 31, 61.

The folder-loader assembly, as seen primarily in FIGS. 1-7, comprises a base 26, a pair of left vertical supports 21 which are rigidly attached to base 26, a left horizontal support 23 which is rigidly attached to top ends of supports 21, a pair of right vertical supports 22 which are rigidly attached to base 26 and a right horizontal support 24 which is rigidly attached to the top ends of supports 22. In combination, base 26, vertical supports 21, 22 and horizontal supports 23, 24 form a rigid frame which supports the folding, loading and packing means of the folder-loader assembly of the invention.

Figure 2:
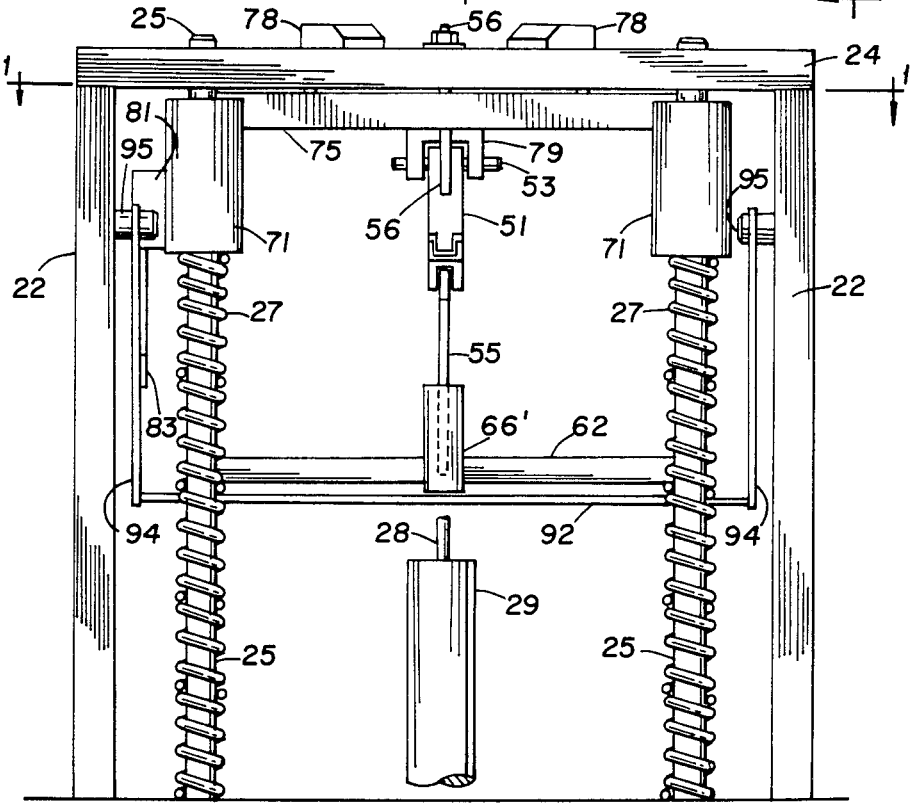
FIG. 2 is a side elevation view of a folder-loader assembly, looking in the direction of the arrows 2—2 in FIG. 1.
Figure 4:
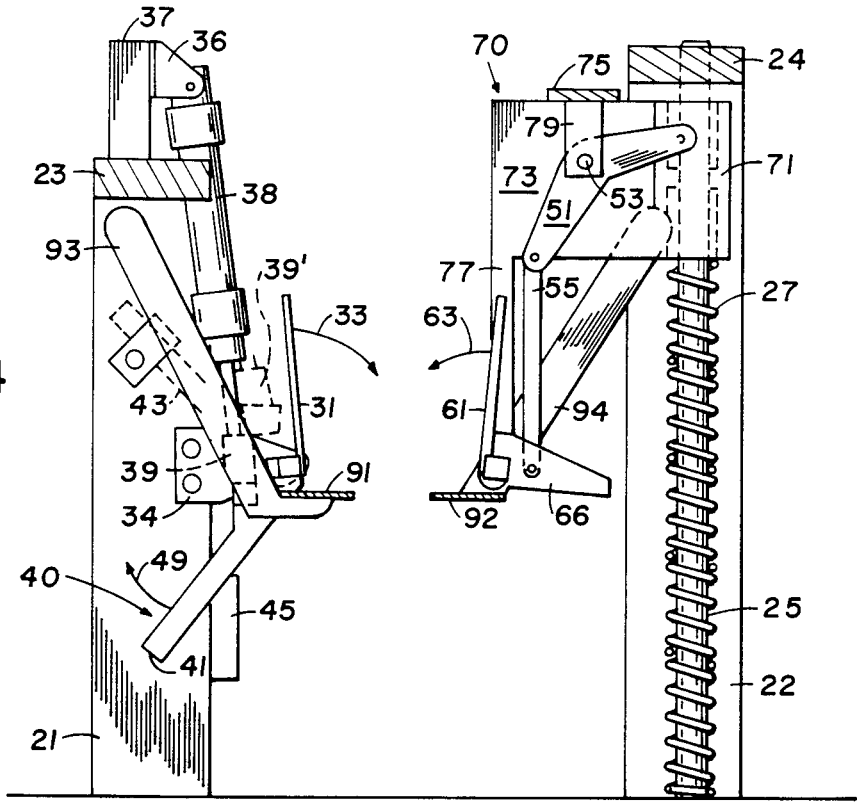
FIG. 4 is a sectional elevation view of the folder-loader assembly, looking in the direction of the arrows 4—4 in FIG. 1, but with the right flipper in standby position.
Figure 7:
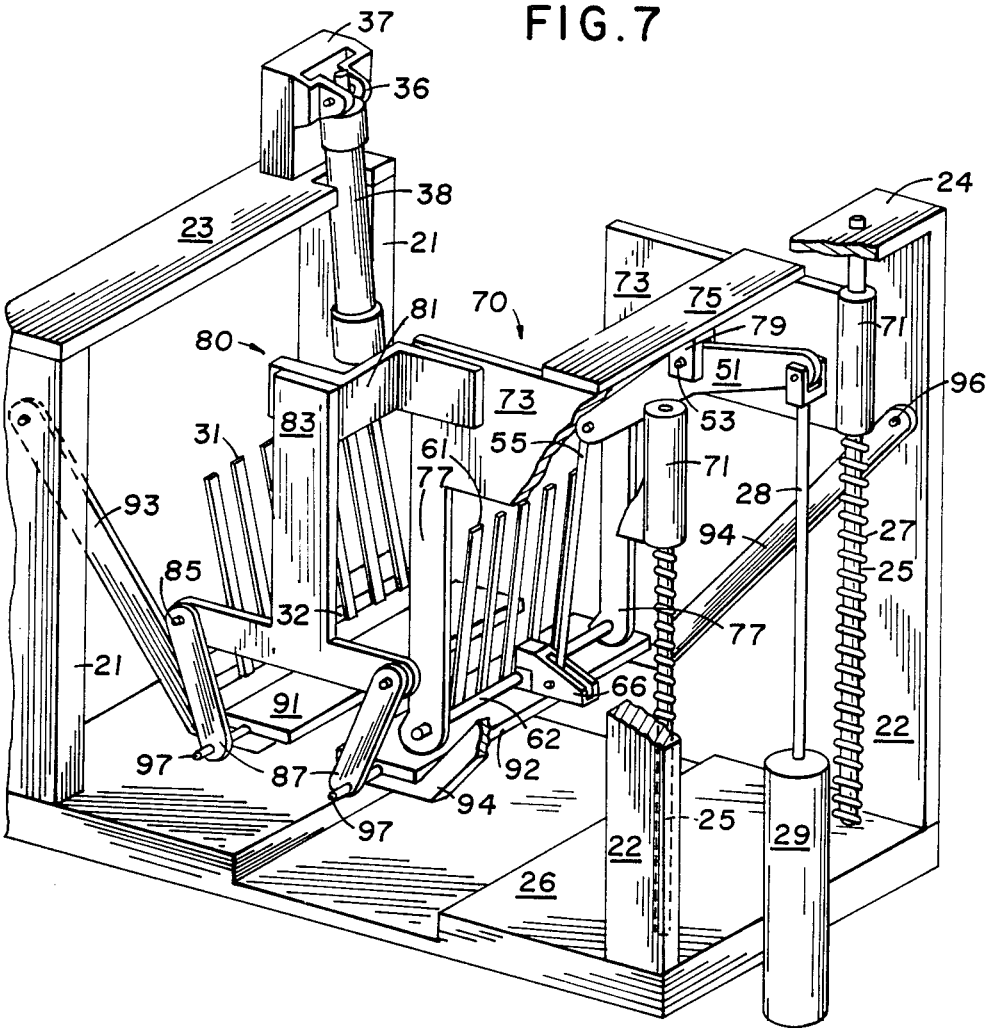
FIG. 7 is an isometric view of the folder-loader assembly from the right-front corner, with parts broken away.
Figure 8:
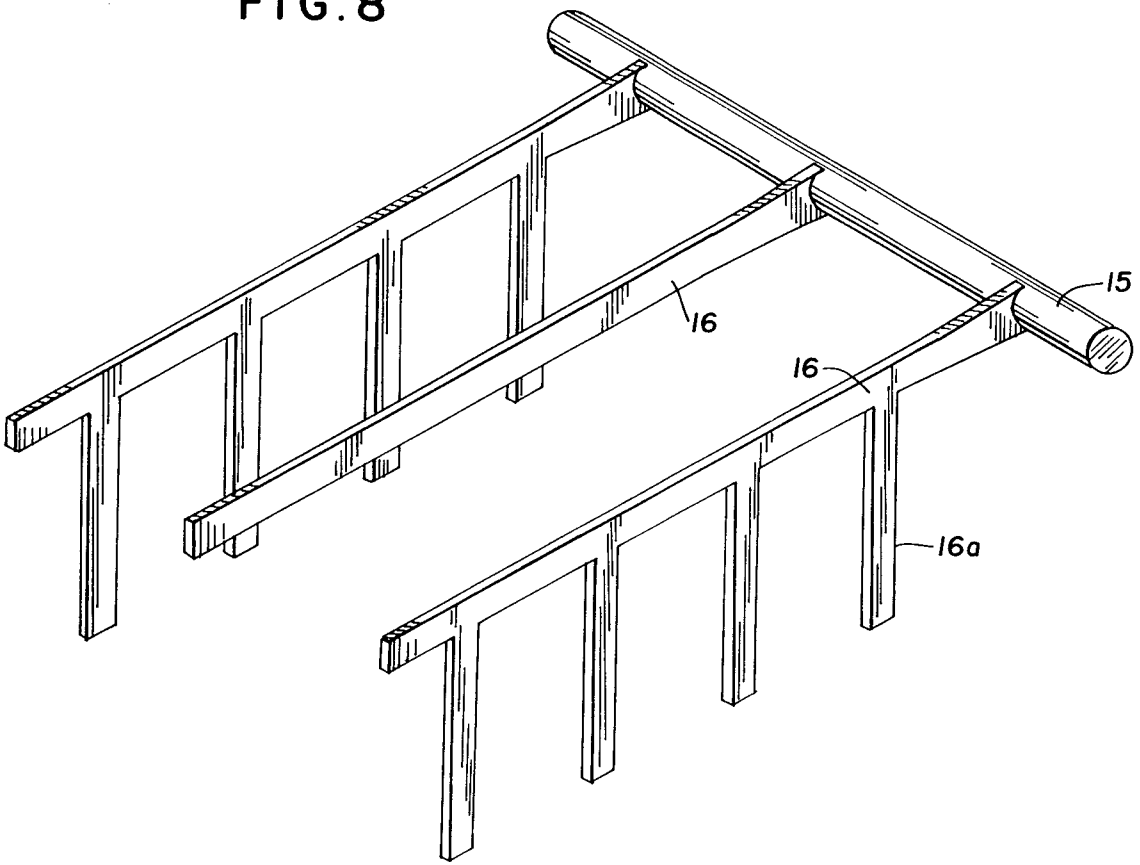
FIG. 8 is an isometric view of a swatter.

Guide rods 25 are also attached to base 26 and to right horizontal support 24, as partially indicated in FIG. 7. Coil springs 27, as seen in FIGS. 2, 4 and 7, encircle guide rods 25 and perform important biasing functions which separate secondary folding, loading and packing operations, as is described hereinafter. A loading cylinder 29, having a cylinder rod 28, is also attached to base 26 between supports 22.

A left flipper assembly 30, for performing the first folding operation on the left end portion 11 of bag 10, comprises a left flipper having tines 31 and shaft 32, a mounting bracket 34, to which shaft 32 is rotatably attached and a left flipper cylinder 38 which is attached to left horizontal support 23 with a mounting block 37 and mounting block bracket 36. The rod for cylinder 38 has at its lower end a clevis 39 which is attached to left flipper arm 41.

Arm assembly 40 comprises a left flipper arm 41, an upper stop 43 for arm 41 and a lower stop 45 for arm 41. Stops 43 and 45 are rigidly attached to rear left support 21, as seen in FIG. 4, although they are omitted in FIG. 1. Tines 31 revolve in direction 33 to perform their folding movement, while arm 41 revolves in direction 49 from stop 45 to stop 43.

Figure 14:
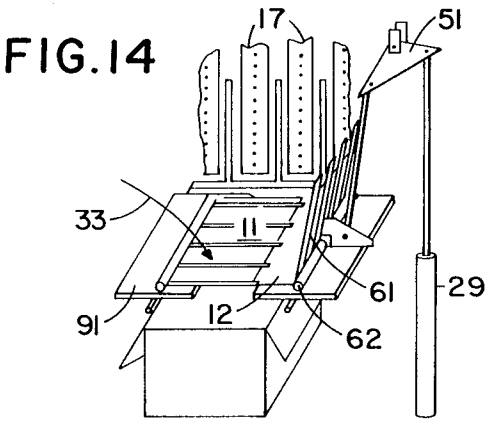
FIG. 14 is a perspective view, similar to FIGS. 12 and 13, which shows the left end portion being folded onto the middle portion by the left flipper.

Left flipper assembly 30 is promptly actuated by cylinder 38 after the swatter has pivotally departed. Its tines 31 pivot in direction 33 and fold end portion 11 onto middle portion 12, as seen in FIG. 14, and then immediately return to upright position.

The second folding operation, the loading operation and the packing operation are performed by a double-function means for utilizing a singly and linearly applied force in order to perform a pivoting movement and then a linear movement, wherein the pivoting movement accomplishes the second folding operation and the linear movement accomplishes both the loading operation and the packing operation. This double-function means is a combined apparatus which is attached to right vertical supports 22 and/or right horizontal support 24. Specifically, a rocker arm assembly 50, comprising a rocker arm 51, a rocker arm pivot 53 and a right flipper link 55, is pivotally attached to the upper end of cylinder rod 28 so that the right portion of rocker arm 41 is pulled in movement 57 as rod 28 is retracted. Correspondingly, the left portion of rocker arm 51 pivots in direction 59 as rod 28 retracts. This pivoting movement of arm 51 causes right flipper link 55 to move leftwardly and upwardly, as seen in FIG. 5, to position 55'.

Right flipper assembly 60 comprises a right flipper having flipper shaft 62 and tines 61 which are perpendicularly attached to flipper shaft 62, and a right flipper arm 66, having a link stop channel 68 therewithin, which is pivotally attached to the lower end of line 55.

A pair of carriers 70 each comprise a bushing within cylinders 71 for a guide rod 25, a carrier support plate 73 which is rigidly attached to cylinder 71, a carrier support arm 77 which is extended downwardly from the inner end of plate 73 and is rigidly attached thereto and a carrier tie bar 75 which is ridigly attached to the top edges of plates 73 and maintains them in parallel and rigidly aligned relationship. Carrier assembly 70 further comprises a rocker arm attachment bracket 79 which is rigidly attached to the lower side of carrier tie bar 75 and midway between cylinders 71, as seen best in FIG. 2. Rocker arm pivot 63, supporting rocker arm 51, passes through bracket 79.

Figure 1:
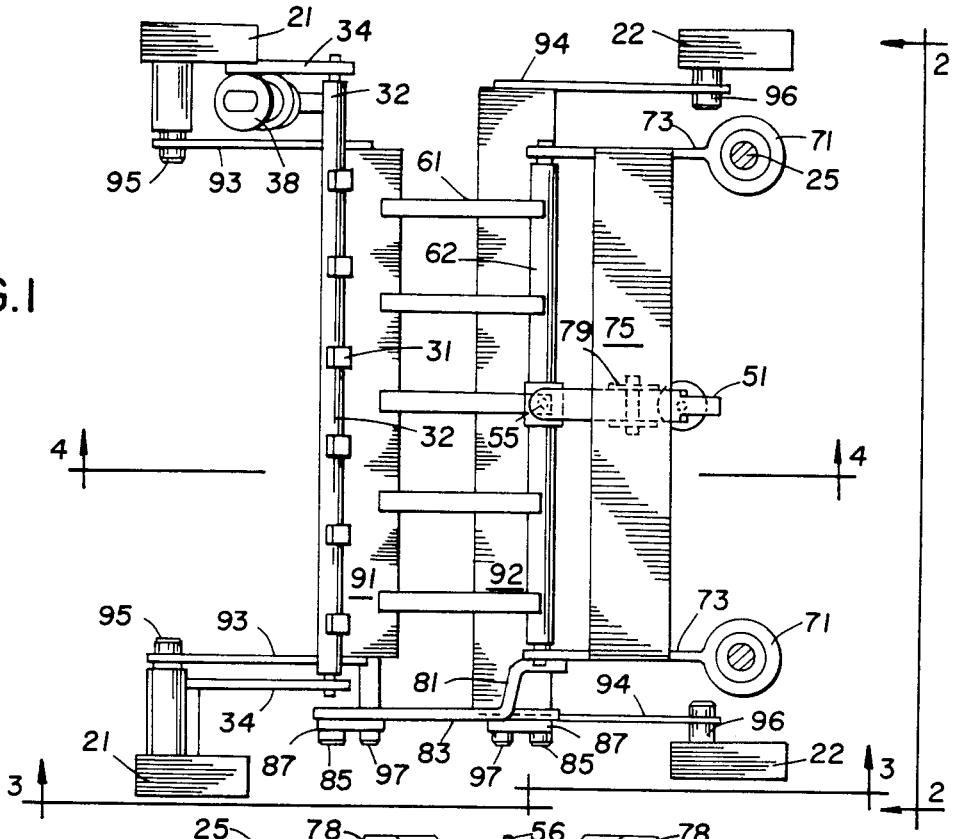
FIG. 1 is a plan view of a folder-loader assembly, with a right flipper in fold position.
Figure 15:
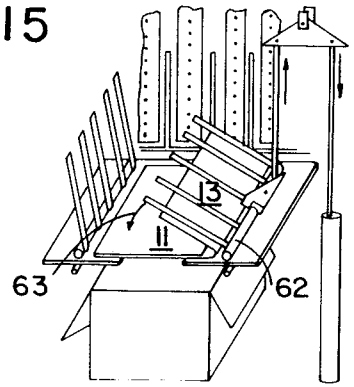
FIG. 15 is a perspective view, similar to FIGS. 12–14, which shows the right end portion being folded onto the left end portion by the right flipper, after the left flipper has returned to its original position.

As best seen in FIG. 5, when cylinder rod 28 is retracted, bringing right end of rocker arm 51 downward in movement 57 and the left end in reverse corresponding movement 59, so that link 55 moves to position 55', right flipper arm 66 pivots to position 66' and prongs 61 pivot in direction 63 to position 61', as seen in FIG. 1 and in phantom in FIG. 5, thereby laying end portion 13 onto end portion 11, as seen in FIGS. 5, 12 and 15.

The sheet-folding assembly has completed its operation at this point in time, except for returning tines 60 to upright position. However, tines 61 and right flipper shaft 62 must first take part in loading and packing each folded bag 14 before returning to upright position, as parts of a folded-sheet loading and packing assembly which additionally comprises a tray actuator bracket assembly 80 and a pair of stacking tray assemblies.

Figure 3:
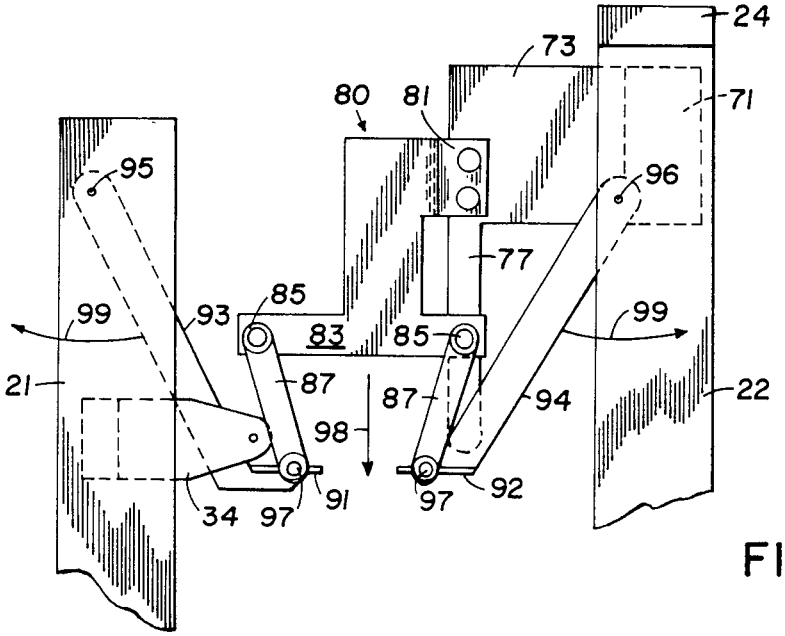
FIG. 3. is a front elevation view of the folder-loader assembly, looking in the direction of the arrows 3—3 in FIG. 1.

Tray actuator bracket assembly 80 comprises a bracket connection 81, a T-member 83, a pair of pivots 85 and a pair of tray links 87, as shown in FIGS. 1 and 3. A pair of stacking tray assemblies comprises left stacking tray 91, right stacking tray 92, a pair of left stacking tray arms 93, a pair of right stacking tray arms 94, left stacking tray arm upper pins 95, right stacking tray arm upper pins 96 and lower stacking tray pins 97. Bracket connection 81 attaches tray actuator bracket assembly 80 to front carrier support plate 73. The pair of pins 85 attach the pair of tray links 87 to T-member 83 and the pair of pins 97 attach links 87 to trays 91, 92, to which tray arms 93, 94 are rigidly attached. Pins 95, 96 respectively attach arms 93, 94 to vertical supports 21, 22 at both front and back of the frame.

Figure 11:
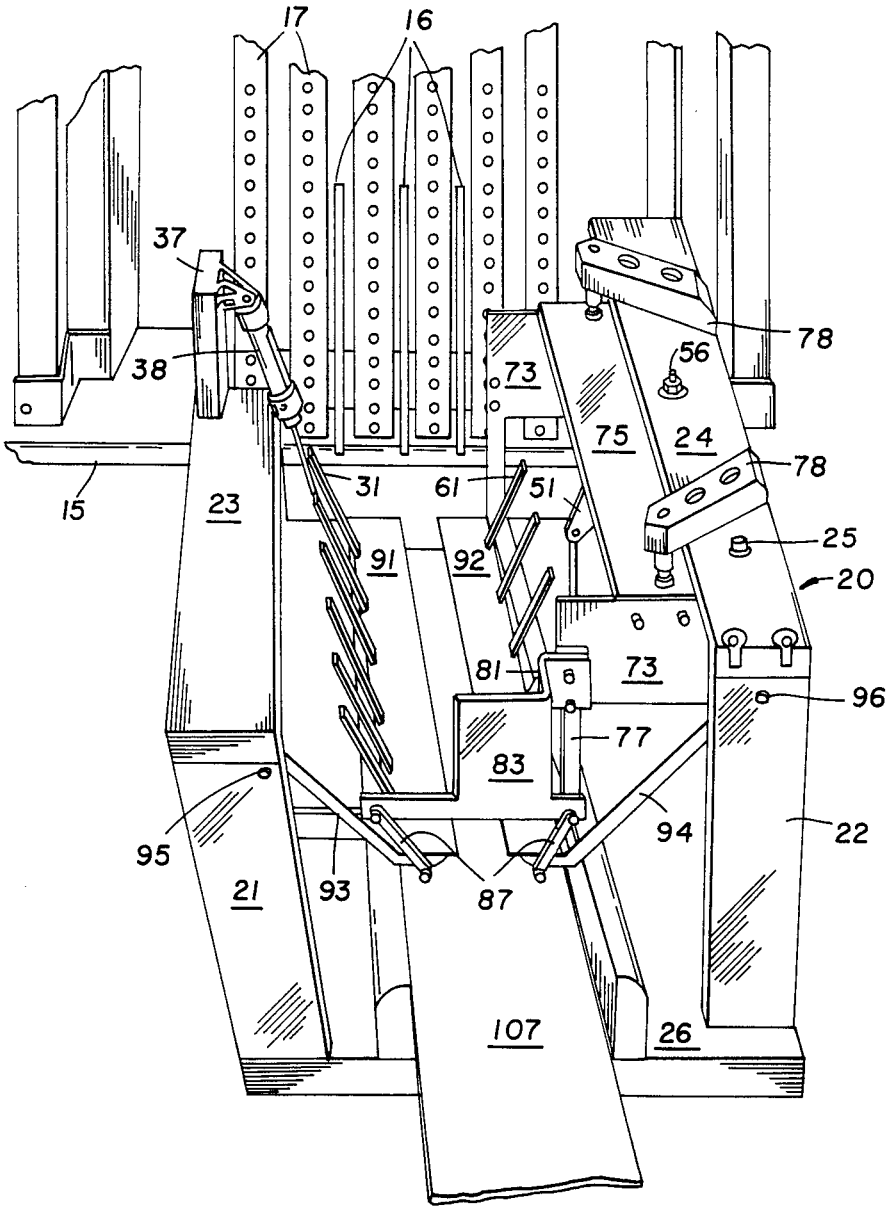
FIG. 11 is a complete front perspective view of the folder-loader assembly and a portion of a machine for making sandwich bags, including vertically disposed conveyor belts and a pivotable swatter for lifting the middle portion of a sandwich bag from the adjacent conveyor.
Figure 16:
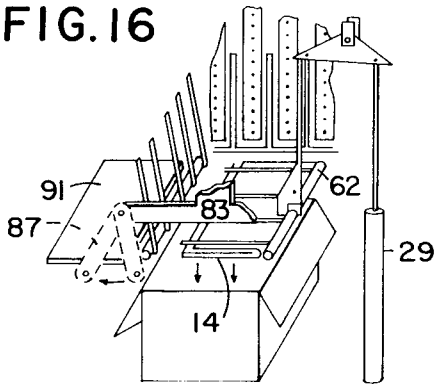
FIG. 16 is a perspective view, similar to FIGS. 12–15, which shows the trays moving sidewardly while the right flipper is propelling the folded bag downwardly into the box.

The folded-sheet loading assembly thereupon begins to operate by sidewardly revolving trays 91, 92 in directions 99 and pushing each folded bag 14 toward bottom 101 of carton 100 by propelling shaft 62 and tines 61 of the right flipper in direction 98, as shown in FIGS. 5 and 16, until the folded bags 14 are squeezed against bottom 101 with a force controlled by a packing force which equals the force of cylinder 29 less the force of springs 27 plus the weight of rocker arm assembly 50, right flipper assembly 60, carrier assembly 70, tray actuator bracket assembly 80, right stacking tray 92, right stacking tray arms 94 and right stacking tray pins 95, 96, 97. The sheet folding assembly then upwardly raises shaft 62 and tines 61 and finally pivots tines 61 to upright position, to be ready for delivery of the next bag 10, as seen in FIG. 11.

This combination of folding, loading and stacking operations is achieved by providing in springs 27 the correct amount of force to support at least the combined weights of the right flipper assembly, the carrier arm assembly and the rocker arm assembly and additionally to resist the force required for cylinder 29 to pull rocker arm 51 in a clockwise pivotal movement, as seen in FIG. 5, until tines 61 have completed the second folding operation. As further downward movement of rod 28 occurs, cylinder 29 overcomes the force of springs 27 and moves carrier assembly 70 and tray actuator bracket assembly 80 downwardly as a unit until the right flipper propels folded bag 14 onto bottom 101 or onto previously stacked bags 14 with a selected packing force.

Coil springs 27, as the biasing means, are suitably five springs surrounding each guide rod 25. Each spring is suitably 2¼ inches high when uncompressed and 0.46 inch high when fully compressed. The loading is 3.68 pounds per inch of compression. The springs are preloaded by fitting five springs into a total height of 7 inches for rods 25. The total travel distance when packing sandwich bags is four inches, which is divided among the five springs on each rod 25. Suitable springs are LC-038G11, sold by the Lee Spring Co.

After the completion of the loading and stacking operations, cylinder 29 extends rod 28, thereby relieving the pressure on springs 27 and allowing the entire unitary combination of right flipper assembly 60, carrier assembly 70 and tray actuator bracket assembly 80 to rise to the level of the folding station, as seen in FIG. 5, as trays 91, 92 simultaneously return to restore the platform of the U-shaped channel. Thereafter, as rod 28 continues to move upwardly, the right end of rocker arm 51 pivots counterclockwise and right flipper arm 66 pivots clockwise, as seen from the front of the folder-loader, so that tines 61 also pivot clockwise to come back to approximately upright position, thereby restoring the U-shaped channel of the folder-loader.

The apparatus is simplified because left flipper assembly 40 is actuated by air cylinder 38, swatter shaft 15 is actuated by a separate cylinder (not shown in FIGS. 1–17), and all the rest of the motion is accomplished by cylinder 29 acting through a linkage. The right flipper pivots on shaft 62 at the bottom ends of vertical arms 77 of the carrier assembly 70, because carrier cylinders 71 are supported by springs 27 on guide rods 25. When cylinder rod 28 pulls on rocker arm 51, it is trying to pull down the main supports of carrier assembly 70 and tray actuator bracket assembly 80, because rocker arm 51 is pivoted on carrier tie bar 75, but the spring force of springs 27 is sufficiently great that it is easier for rocker arm 51 to pivot. This downward force then pulls flipper link 55 upwardly, which in turn pivots flipper 66, causing the right flipper to rotate counterclockwise in direction 63. It is stopped in a horizontal position when right flipper link 55 strikes link stop channel 68.

Then, as cylinder 29 continues to pull downwardly, it overcomes the force of springs 27 and moves carrier assembly 70 and bracket assembly 80 downwardly, causing arms 93, 94 to pivot and trays 91, 92 to revolve downwardly and outwardly to the sides, so that relative to folded bag 14, trays 91, 92 simply move sidewardly out of the way as the right flipper and bag 14 are propelled in direction 98 toward bottom 101 of carton 100. There is sufficient travel distance available in direction 98 for each folded bag 14 to be pressed against bottom 101 or against previously stacked bags 14, with the full packing force to effectuate stacking of the bags into carton 100.

Because link stop channel 68 remains in contact with right flipper link 55 after the downward movement begins and until the right flipper returns to the folding station, the right flipper is held in its horizontal position during its up-and-down vertical travel. Stops 78 on support 24 are adjusted for accurately positioning tines 61 in standby or article-receiving position, slightly outwardly of vertical, after completion of the return movement of cylinder rod 28.

As seen in FIGS. 1–17, the folding station comprises trays 91, 92 and left and right flipper tines 31, 61. The folding means comprises left and right flipper assemblies 30, 60, left flipper arm assembly 40 and rocker arm assembly 50.

The propulsion means comprises loading cylinder 29 and loading cylinder rod 28. The fixed part of the support and guide means comprises vertical supports 21, 22, horizontal supports 23, 24, guide rods 25 and base 26. The movable part of the support and guide means comprises carrier assembly 70 and tray actuator bracket assembly 80. Carrier assembly 70, bracket assembly 80, rocker arm assembly 50 and right flipper assembly 60 (while the right flipper is horizontal) can be collectively described, on a functional basis, as a "stomper" apparatus. The guides utilized by the movable part are guide rods 25, which are acted upon by the bushings within carrier cylinders 71.

Thus far, description has been made of the apparatus and its operation as disclosed in co-pending application Ser. No. 329,371. The present invention improves upon this apparatus by simplifying the mechanism for positioning and moving trays 91 and 92, upon which the sheet-like article, e.g., bag 14, is folded. The present invention also provides an improved propulsion mechanism, termed a "stomper" apparatus above, for pushing a folded sheet into carton 100. The modifications to the FIGS. 1–17 apparatus employed in the apparatus of the present invention are shown in FIGS. 18–22, wherein structures like those in FIGS. 1–17 have the same reference numbers.

Figure 19:
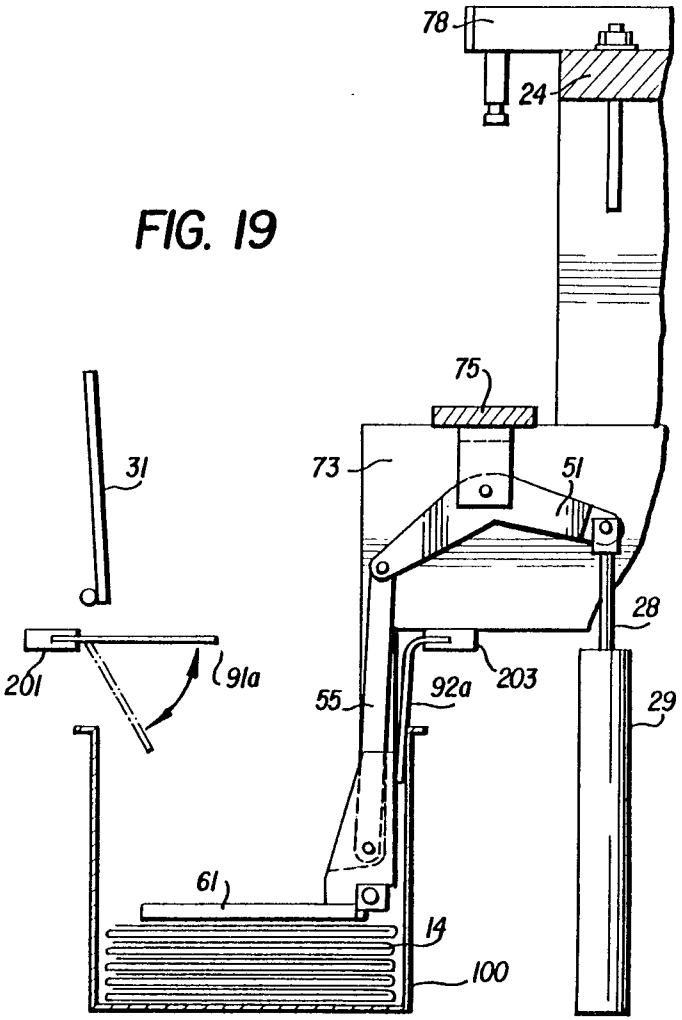
FIG. 19 is a partial sectional view similar to FIG. 6, but showing the tray support and movement structures employed in the first embodiment of the present invention.
Figure 18:
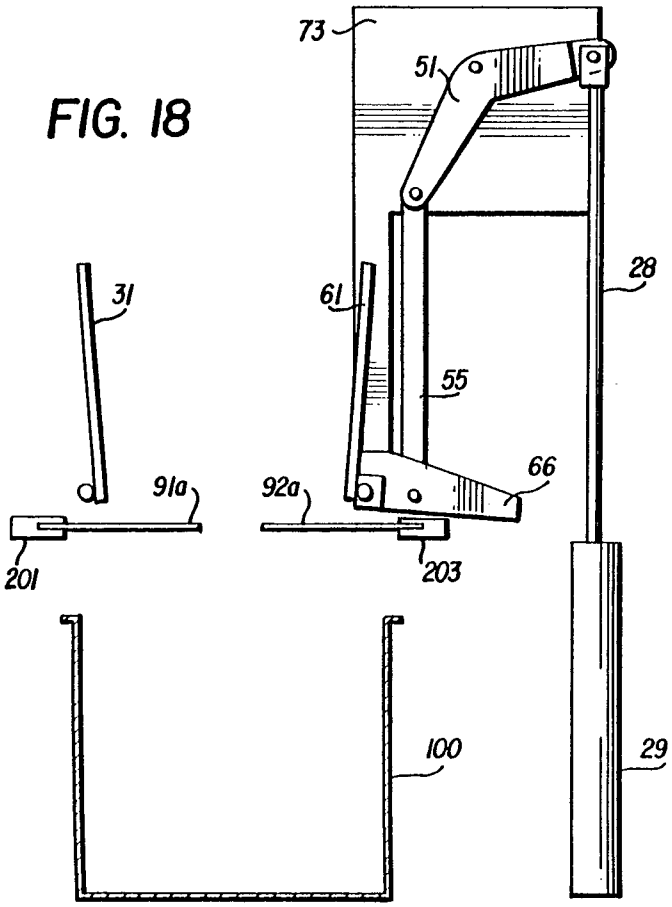
FIG. 18 is a partial sectional view similar to FIG. 5, but showing the tray support and movement structures employed in a first embodiment of the present invention.
Figure 20:
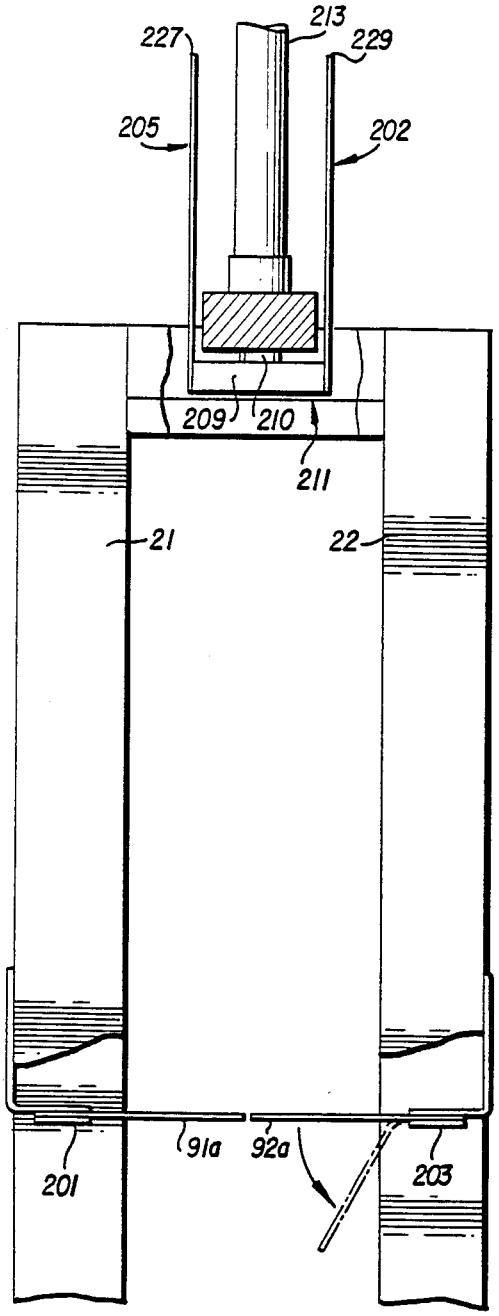
FIG. 20 is a front elevation view similar to FIG. 3, but showing a simplified stomper apparatus employed in a second embodiment of the present invention.

In the present invention, the complex linkage assembly for positioning and moving support trays 91 and 92 is replaced by a simple support structure, illustrated in FIGS. 18 and 19. Each of the trays 91*a* and 92*a*, which opposes the other at its inner edge, is formed of a flexible plastic sheet which is held at its outermost edge by a respective fixed support bracket 201 or 203. The support brackets 201 and 203 are suitably fixed to a stationary support, for example, the vertical supports 21, 22, as shown in FIG. 20. Suitable trays 91*a* and 92*a* can be constructed of a plastics material, such as 0.020" thick crystallized polyester sheet. The fixed support brackets 201, 203 cause the trays 91*a,* 92*a* to bend against their inherent biasing when the loading mechanism formed by tines 61 of right flipper 55 move vertically downward to push a folded bag 14 toward the bottom 101 of carton 100, as described above with reference to FIGS. 5 and 6. This operation is shown in FIGS. 18 and 19, wherein FIG. 18 shows the position of the folding/loading apparatus immediately before the folding of bag 14, and FIG. 19 shows the packing of carton 100 by tines 61 with the folded bag. As shown in FIG. 19, after the left flexible tray 91*a* is first deflected downward by downwardly moving tines 61', it then disengages therefrom upon further downward movement of tines 61' and returns by its inherent biasing to a horizontal position. On the other hand, the right flexible tray 92*a* remains in contact with portions of right flipper 55 throughout its downward movement and remains deflected until right flipper 55 reciprocates and returns to the position illustrated in FIG. 18. As right flipper 55 returns to the FIG. 18 position, the inherent biasing of right flexible tray 92*a* causes it to return to a horizontal position. Left flexible tray 91*a* also engages again with tines 61' as the latter moves upward and is deflected upwardly slightly until it clears tines 61' and then moves therebelow, returning to its horzontal position, as shown in FIG. 18.

The fixed tray supporting brackets 201, 203 and flexible trays 91*a,* 92*a* are simple in construction and eliminate the need for the complex assembly described above employing tray actuator bracket assembly 80, bracket connection 81, T-member 83, pivots 85, tray links 87, left stacking tray arms 93, right stacking tray arms 94, left and right stacking tray arm upper pins 95, 96 and lower stacking tray pins 97. The remaining conveying, folding and loading apparatus described above with reference to FIGS. 1–17 remains the same.

Figure 21:
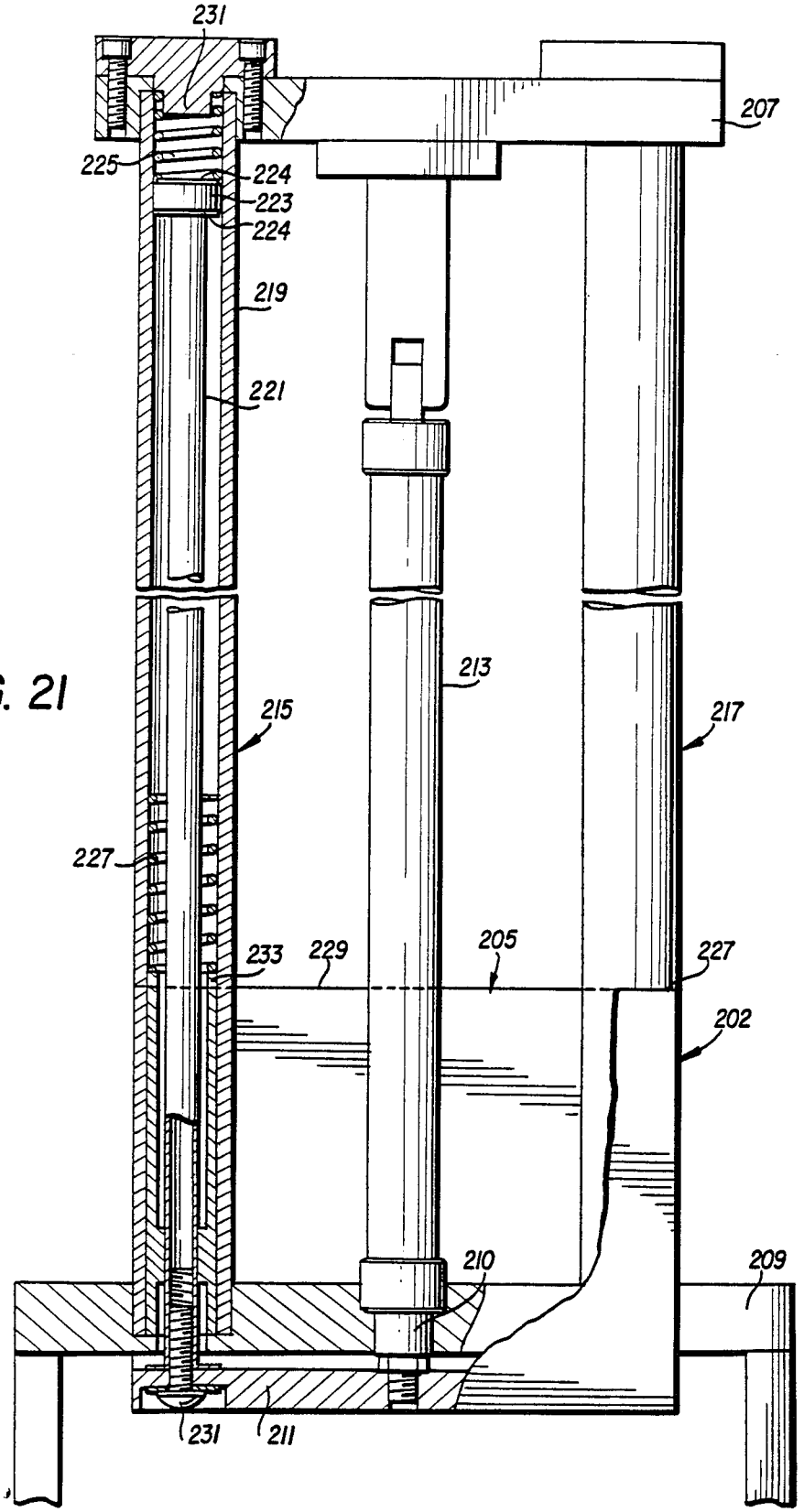
FIG. 21 is a side view of a portion of the structure shown in FIG. 20.

A further simplification of the folding and loading apparatus in accordance with a second embodiment of the present invention is shown in FIGS. 20 and 21. The bag folding left and right flippers and associated moving mechanisms have been omitted in FIG. 20 for the purpose of clarity. In this embodiment, flexible trays 91*a,* 92*a* are employed as in the first embodiment. In addition, a simple stomper apparatus, separate from the folding apparatus, is employed for pushing a folded bag on the trays into carton 100. Consequently, the complicated stomper apparatus described above, which causes the downward vertical movement of tines 61', can be eliminated.

The simplified stomper apparatus of the invention, generally designated as 202 in FIG. 20, is mounted above the flexible trays 91*a,* 92*a* by a distance sufficient to allow the tines 16 of the swatter arm to rotate and convey a plastic bag 14 from the conveyor belts 17 to the folder assembly, the latter being shown, for example, in FIG. 7. It comprises fixed top and bottom support brackets 207 and 209, a driving piston 213, a pair of guide rod assemblies 215 and 217 and a reciprocal U-shaped stomper member 205, having a bottom 211 and upstanding sidewalls 229. The bottom 211 of the stomper member 205 is fixed to a piston rod 210 at one end of actuating cylinder 213 which passes through bracket 209, while the other end of actuating cylinder 213 is fixed to top support bracket 207. Accordingly, actuation of cylinder 213 causes vertical movement of stomper member 205.

Guide rod assemblies 215 and 217 serve to prevent rotation of the stomper member 205 about the axis of actuating cylinder 213 and also contain internal structures for defining the upper and lower positions at which stomper member 205 stops in its vertical movement and for slowing the stomper member as it nears the ends of its reciprocal travel. Each rod assembly includes an outer tube 219, in which an inner rod member 221 is mounted. One end of the inner rod member 221 is fixed by a fastening bolt or screw 231 to the bottom 211 of stomper member 205, while the other end is fixed to a bushing 223 sandwiched by washers 224, which rides along the inner periphery of outer tube 219. Bushing 223 has an outer periphery larger than that of rod 221 and washers 224. Bushing 223 or associated washers 224 engage with springs 225 and 227 provided within and at opposite ends of tube 219 as rod 221 moves up and down. The springs serve to slow movment of stomper member 205 as it nears the ends of its vertical travel. Fixed stoppers 231 and 233 are also provided within tube 219 to positively define the end points of the movement of rod 221 and consequently stomper member 205.

The stomper apparatus is activated after a bag 14 has been folded on flexible trays 91*a,* 92*a,* in the manner described above with reference to FIGS. 1–14. After the bag 14 has been folded, the tines 61 of the folder apparatus are returned to their upright (vertical) position, shown in FIGS. 4, 5 and 11, following which cylinder 213 is actuated to vertically lower U-shaped stomper member 205, causing it to push the folded bag against and through the flexible trays 91*a,* 92*a* and press the bag to the bottom of carton 100. The upstanding sidewalls 229 of the stomper member 205 remain engaged with and thus hold the trays 91*a,* 92*a* in their bent conditions as a bag is pressed into carton 100. When the stomper member 205 is withdrawn, by being moved by actuating cylinder 213 vertically upwardly, the flexible trays 91*a,* 92*a* return by means of their inherent biasing to their horizontal positions.

The stomper apparatus illustrated in FIGS. 20 and 21 permits a simplified construction of the right flipper assembly for folding the bag, since it is not necessary to also use this assembly to press a bag into carton 100. Thus, it is not necessary to have a movable carrier support plate 73, springs 27 and other associated structures to move shaft 62 and tines 61 vertically downwardly, as described above with reference to FIGS. 1–17, thus providing a simplified and more reliable folder construction. A simple actuating cylinder can instead be used to rotate tines 61 of the right flipper for the folding operation.

Figure 22:
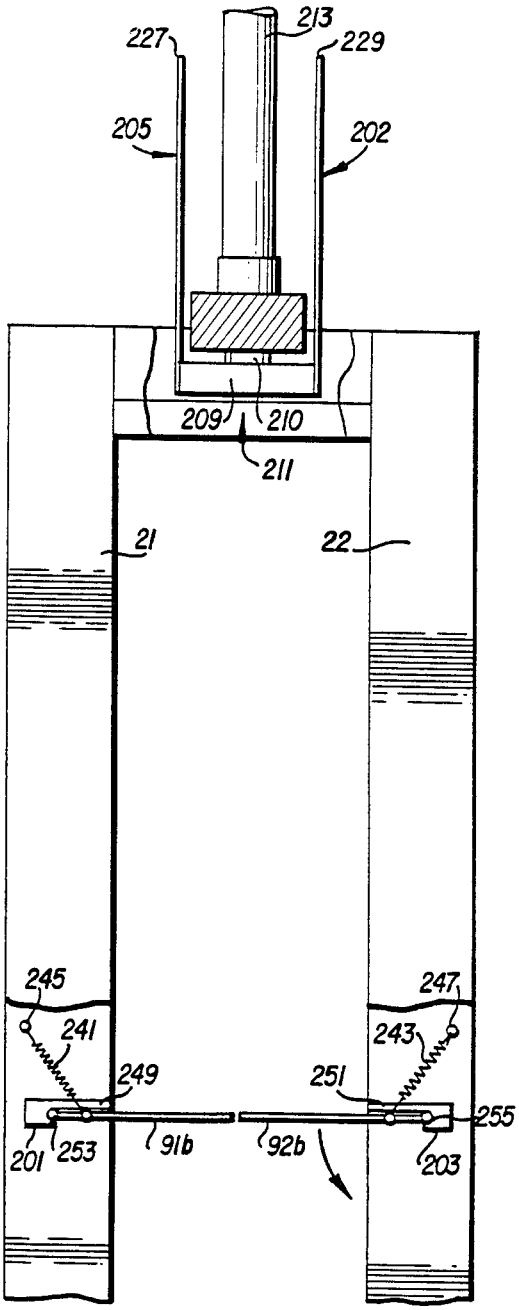
FIG. 22 illustrates in end view a modification of the tray support structures shown in FIGS. 18 and 19.

In the two embodiments of the invention described thus far, the support trays 91*a,* 92*a* are constructed as flexible sheets. It is also possible to construct the trays as rigid sheets 91*b,* 92*b,* which are pivotably supported at their outermost extremities to fixed support brackets 201 and 203, as shown in FIG. 22. In the modification shown in FIG. 22, the rigid support trays 91*b,* 92*b* are pivoted about pins 253 and 255, respectively, to support brackets 201 and 203. Respective tension springs 241, 243, connected between fixed pins 245 and 247 and respective trays 91*b,* 92*b,* bias the trays upwardly against fixed stops 249 and 251, which define the horizontal orientation of the trays. This tray construction can be used with the separator stomper apparatus illustrated in FIGS. 20 and 21.

As is apparent from the foregoing description, the support tray arrangement of the invention affords a simpler construction and operation over the support tray construction and associated linkage mechanism described above with reference to FIGS. 1–17, permitting a more reliable and efficient operation of the entire folding and loading apparatus. Likewise, the stomper apparatus described above with reference to FIGS. 20 and 21 affords a simplified, more reliable and efficient operation over the stomper apparatus described with reference to FIGS. 1–17.

While preferred embodiments of the invention have been shown and described, it should be apparent that many modifications can be made without departing from the spirit and scope of the invention. Accordingly, the invention is not limited by the foregoing description, but is only limited by the scope of the claims appended hereto.

We claim:

1. An apparatus for sequentially folding and loading a plurality of thin, limp, sheet-like articles in a carton therefor, comprising:

a folding station, comprising:

a pivotal platform biased to a first predetermined position, to which each said article is sequentially delivered; and a folding means, which is in standby position and alongside said platform when said article is delivered onto said platform, for sequentially folding at least one portion of said article onto another portion thereof; and a loading assembly for sequentially loading each said folded article into said carton, said carton having a bottom which is aligned with and transversely spaced from said folded article on said platform, said loading assembly comprising:

a propulsion means for pivotally moving said platform against said biasing to a second predetermined position, which permits movement of said folded article into said carton, and for propelling a folded article into said carton, and thereafter allowing said platform to return to said first position.

2. An apparatus as in claim 1, wherein said platform comprises a pair of pivotally supported trays, said propulsion means engaging with and pivoting said trays from said first to said second predetermined positions.

3. An apparatus as in claim 1, wherein said propulsion means comprises a reciprocal mechanism which engages with an article after it is folded and with said pivotal platform to pivot the same and propel a folded article into said carton.

4. An apparatus as in claim 3, wherein said propulsion means comprises an element of said folding means which folds at least one portion of said article onto another portion thereof and which thereafter operates to pivotally move said platform and propel a folded article into said carton.

5. An apparatus as in claim 3, wherein said propulsion means comprises a reciprocal stomper member which is positioned above said article and platform during folding of said article and which moves downwardly to engage with and pivot said platform and also propel a folded article into said carton.

6. An apparatus as in claim 5, wherein said stomper member has a U-shaped cross-section.

7. An apparatus as in claim 1, wherein said platform is formed of at least one flexible tray which is fixed at one edge thereof so as to be biased to said first predetermined position and to pivot upon operation of said propulsion means.

8. An apparatus as in claim 7, wherein said platform is formed by a pair of flexible trays which oppose one another at first edges thereof and which are fixed at outward second edges thereof opposite to said first edges.

9. An apparatus as in claim 8, wherein said trays are formed of a crystalized polyester sheet.

10. An apparatus as in claim 1, wherein said platform is formed of at least one rigid tray which is pivoted to a support member and which is biased by a biasing means toward said first predetermined position.

11. An apparatus as in claim 10, wherein said platform is formed by a pair of rigid trays which oppose one another at first edges thereof and which are pivoted adjacent outward second edges thereof opposite to said first edges and which are biased by said biasing means towards said first predetermined position.

12. An apparatus as in claim 5, further comprising means for reciprocally moving said stomper member and means for guiding said stomper member in its reciprocal movement.

13. An apparatus as in claim 5, further comprising means for slowing the movement of said stomper member as it reaches end points of its reciprocal movement.

14. An apparatus as in claim 13, further comprising stop means which act on said stomper member to positively define said end points.

15. An apparatus for sequentially delivering, folding and loading a plurality of thin, limp, sheet-like articles into a receptacle having a bottom, after said articles have been sequentially conveyed to a pickup station, and for packing said loaded articles within said receptacle, comprising:

a delivery assembly for sequentially delivering said articles to a folded station, comprising:

a pivotable swatter, having at least one member which is perpendicularly disposed to the axis of rotation of said swatter, which is disposed and actuated so that said member is pivotally beyond each said article when said article arrives at said pickup station, whereby said article is lengthwise divided by said member of said swatter into three parts; and a first actuator means for revolving said swatter through an arc, whereby said article is delivered to said folding station with a middle portion supported by said swatter and with first and second end portions partially folded beyond said member of said swatter;

a folding assembly for sequentially folding said articles, comprising:

a pair of pivotable trays fixed at respective outer edges and biased so as to be disposed in side-by-side relationship to form a platform which is aligned with, parallel to, but spaced from said bottom and is adapted to receive at least said middle portion;

a pair of pivotable flippers which are disposed approximately perpendicularly to said platform when in article-receiving position and are spaced apart by about the length of one said part to form said folding station, in combination with said trays, as a U-shaped channel;

a second actuator means for pivoting one said flipper through about 90° to lay said first end portion onto said middle portion and for returning said one flipper to said article-receiving position;

a third actuator means for pivoting the other said flipper through about 90° to lay said second end portion onto said first end portion, whereby said article is fully folded, and for returning said other flipper to said article-receiving position; and a loading assembly for loading said fully folded articles into said receptacle and for packing said articles against said bottom with a selected force, comprising:

a tray-removing means for pivoting said pair of trays from said side-by-side relationship to permit insertion of said articles into said receptacle; and a propulsion means for transversely moving said other flipper and said fully folded article toward said bottom to effectuate said loading and for returning said other flipper to said folding station after said packing.

16. The apparatus of claim 15, whereby said third actuator means, said tray-removing means, and said propulsion means comprise a single cylinder and its cylinder rod which is connected to said other flipper.

17. The apparatus of claim 16, wherein said other flipper is pivotally connected to a rigid carrier member which is connected to said cylinder rod.

18. The apparatus of claim 17, further comprising a spring which supports said other flipper and said carrier member until pivoting of said other flipper is completed and thereafter permits said transversely moving to occur.

19. An apparatus as in claim 15, wherein said trays are formed of a crystalized polyester sheet.

20. An apparatus for sequentially, delivering, folding and loading a plurality of thin, limp, sheet-like articles into a receptacle having a bottom, after said articles have been sequentially conveyed to a pick-up station, and for packing said loaded articles within said receptacle, comprising:

a delivery assembly for sequentially delivering said articles to a folding station, comprising:

a pivotable swatter, having at least one member which is perpendicularly disposed to the axis of rotation of said swatter, which is disposed and actuated so that said member is pivotally beyond each said pickup station, whereby said article is lengthwise divided by said member of said swatter into three parts; and a first actuator means for revolving said swatter through an arc, whereby said article is delivered to said folding station with a middle portion supported by said swatter and with first and second end portions partially folded beyond said member of said swatter;

a folding assembly for sequentially folding said articles, comprising:

a pair of pivotable trays which are biased so as to be disposed in side-by-side relationship to form a platform which is aligned with, parallel to, but spaced from said bottom and is adapted to receive at least said middle portion;

a pair of pivotable flippers which are disposed approximately perpendicularly to said platform when in article-receiving position and are spaced apart by about the length of one said part to form said folding station, in combination with said trays, as a U-shaped channel;

a second actuator means for pivoting one said flipper through about 90° to lay said first end portion onto said middle portion and for returning said one flipper to said article-receiving position;

a third actuator means for pivoting the other said flipper through about 90° to lay said second end portion onto said first end portion, whereby said article is fully folded, and for returning said other flipper to said article-receiving position; and a loading assembly for loading said fully folded article into said receptacle and for packing said articles against said bottom with a selected force, comprising a reciprocating stomper member spaced above said trays by a distance sufficient to permit operation of said swatter, said stomper member being downwardly movable for pivoting said pair of trays from said side-by-side relationship to permit insertion of said articles into said receptacle and for packing a fully folded article toward said bottom.

21. An apparatus as in claim 20, wherein said stomper member has a U-shaped cross-section.

22. An apparatus as in claim 20, wherein said pair of pivotable trays are formed by rigid trays which oppose one another at first edges thereof and which are pivoted adjacent outward second edges thereof opposite to said first edges and which are biased by a biasing means so that said trays assume said side-by-side relationship.

23. An apparatus as in claim 20, further comprising means for reciprocally moving said stomper member and means for guiding said stomper member in its reciprocal movement.

24. An apparatus as in claim 20, further comprising means for slowing the movement of said stomper member as it reaches end points of its reciprocal movement.

25. An apparatus as in claim 24, further comprising stop means which act on said stomper member to positively define said end points.

26. An apparatus as in claim 20, wherein said pair of pivotable trays are formed by flexible trays which oppose one another at first edges thereof and which are fixed at outward second edges thereof opposite to said first edges.

27. An apparatus as in claim 26, wherein said trays are formed of a crystalized polyester sheet.

* * * * *